US011605898B2

(12) United States Patent
Dehghanikodnoeih et al.

(10) Patent No.: US 11,605,898 B2
(45) Date of Patent: Mar. 14, 2023

(54) ANTENNA

(71) Applicant: Nokia Shanghai Bell Co., Ltd., Shanghai (CN)

(72) Inventors: Mohammad Reza Dehghanikodnoeih, Trignac (FR); Yoann Letestu, Trignac (FR)

(73) Assignee: Nokia Shanghai Bell Co., Ltd., Shanghai (CN)

( * ) Notice: Subject to any disclaimer, the term of this patent is extended or adjusted under 35 U.S.C. 154(b) by 0 days.

(21) Appl. No.: 17/266,296

(22) PCT Filed: Aug. 8, 2018

(86) PCT No.: PCT/IB2018/055985

§ 371 (c)(1),
(2) Date: Feb. 5, 2021

(87) PCT Pub. No.: WO2020/030952

PCT Pub. Date: Feb. 13, 2020

(65) Prior Publication Data

US 2021/0305714 A1 Sep. 30, 2021

(51) Int. Cl.
*H01Q 15/22* (2006.01)
*H01Q 5/30* (2015.01)

(52) U.S. Cl.
CPC ..... *H01Q 15/22* (2013.01); *H01Q 5/30* (2015.01)

(58) Field of Classification Search
CPC ..... H01Q 15/22; H01Q 5/30; H01Q 1/246; H01Q 3/46; H01Q 15/23; H01Q 19/062;
(Continued)

(56) References Cited

U.S. PATENT DOCUMENTS 3,771,160 A * 11/1973 Laverick ..... H01Q 5/45 343/781 R
5,680,139 A * 10/1997 Huguenin ..... G01S 7/032 343/753

(Continued)

FOREIGN PATENT DOCUMENTS

| | | | |
|---|---|---|---|
| KR | 100835994 | B1 | 6/2008 |
| WO | WO-2014090565 | A1 | 6/2014 |
| WO | WO-2018/098698 | A1 | 6/2018 |

OTHER PUBLICATIONS

Jinjing Ren, "Some studies of Quasi-Planar Antennas", Nov. 21, 2016, Ulm University (Year: 2016).*

(Continued)

*Primary Examiner* — Andrea Lindgren Baltzell
(74) *Attorney, Agent, or Firm* — Harness, Dickey & Pierce, P.L.C.

(57) ABSTRACT

A multi-frequency folded lens antenna structure includes a stack, and the stack includes a polarization-dependent trans-reflector, a dielectric gap, and a multi-frequency twist-reflector; wherein the polarization-dependent trans-reflector is configured to transmit electromagnetic radiation of a first polarization incident from within the stack out of the stack and to reflect electromagnetic radiation of a second, different polarization incident within the stack towards the multi-frequency twist-reflector, and the multi-frequency twist-reflector is configured to selectively change a polarization of the reflected electromagnetic radiation from the second polarization to substantially the first polarization and to direct the electromagnetic radiation of substantially the first polarization, within the stack, towards the polarization-dependent trans-reflector for at least partial transmission out of the stack, wherein the multi-frequency twist-reflector is configured to selectively change the polarization for at least a first frequency band and for at least a second frequency band, non-contiguous to the first frequency band.

19 Claims, 5 Drawing Sheets

(58) Field of Classification Search
CPC .. H01Q 19/185; H01Q 15/242; H01Q 19/195; H01Q 1/425; H01Q 15/08; H01Q 15/248; H01Q 21/064; H01Q 25/008; H01Q 5/45; H01Q 9/28; H01Q 1/38; H01Q 1/225; H01Q 15/24; H01Q 19/108; H01Q 19/30; H01Q 21/30; H01Q 3/2658; H01Q 9/0414; H01Q 9/0428; H01Q 9/065; H01Q 9/26; H01Q 9/42
See application file for complete search history.

(56) References Cited

U.S. PATENT DOCUMENTS

| | | | | |
|---|---|---|---|---|
| 2002/0173342 | A1* | 11/2002 | Kanamaluru ..... | H01Q 19/195 455/562.1 |
| 2004/0207567 | A1 | 10/2004 | Sievenpiper et al. | |
| 2005/0200549 | A1 | 9/2005 | Thompson et al. | |

OTHER PUBLICATIONS

Search Report for European Application No. 18929406.9 dated Feb. 15, 2022.
Jinjing Ren et al: "Some studies of quasi-planar antennas," Nov. 21, 2016 (Nov. 21, 2016), XP055718844, DOI: 10.18725/OPARU-4175 Retrieved from the Internet: URL:https://oparu.uni-ulm.de/xmlui/bitstream/handle/123456789/4214/Dissertation_Ren.pdf?sequence=3&isAllowed=y [retrieved on Jul. 29, 2020], p. 12-p. 92.
International Search Report for International Application No. PCT/IB2018/055985 dated May 7, 2019.

* cited by examiner $Z \propto (w^2.L1.C1-1)(w^2.L2.C2-1)$

ANTENNA

CROSS-REFERENCE TO RELATED APPLICATIONS

This application is a national phase under 35 U.S.C. § 371 of PCT International Application No. PCT/IB2018/055985 which has an International filing date of Aug. 8, 2018, the entire contents of which is hereby incorporated by reference.

TECHNOLOGICAL FIELD

Embodiments of the present disclosure relate to antennas and components for an antenna.

BACKGROUND

Point-to-point radio communication may use a parabolic reflector to create a focused beam of electromagnetic radiation. It is well understood that if a source of electromagnetic radiation is placed at a focal pint of the parabolic reflector, then the parabolic reflector will create a beam of parallel rays of electromagnetic radiation.

Such an antenna can provide a high bandwidth as it can be operated simultaneously over many different frequency bands. However, it is bulky because of the distance of the focal point from the parabolic reflector and the size of the parabolic reflector.

It would be desirable to produce an antenna that is less bulky and operates over multiple frequency bands simultaneously.

BRIEF SUMMARY

According to various, but not necessarily all, embodiments there is provided a multi-frequency folded lens antenna structure comprising: a stack comprising:

a polarization-dependent trans-reflector a dielectric gap a multi-frequency twist-reflector, wherein the polarization-dependent trans-reflector is configured to transmit electromagnetic radiation of a first polarization incident from within the stack out of the stack and to reflect electromagnetic radiation of a second, different polarization incident within the stack towards the multi-frequency twist-reflector, and the multi-frequency twist-reflector is configured to selectively change a polarization of the reflected electromagnetic radiation from the second polarization to substantially the first polarization and to direct the electromagnetic radiation of substantially the first polarization, within the stack, towards the polarization-dependent trans-reflector for at least partial transmission out of the stack, wherein the multi-frequency twist-reflector is configured to selectively change the polarization for at least a first frequency band and for at least a second frequency band, non-contiguous to the first frequency band.

In some, but not necessarily all examples, the multi-frequency twist-reflector is configured to selectively change the polarization for at least the first frequency band and for at least the second frequency band, non-contiguous to the first frequency band and is configured to not selectively change the polarization for at least a third frequency band between the first frequency band and the second frequency band.

In some, but not necessarily all examples, the multi-frequency twist-reflector is configured to have a multi-resonant impedance comprising a resonance at the first frequency band and a resonance at the second frequency band.

In some, but not necessarily all examples, the multi-frequency twist-reflector is configured to have a multi-resonant impedance that is non-resonant at a third frequency band between the first frequency band and the second frequency band, wherein the multi-frequency twist-reflector reflects electromagnetic radiation having a second polarization and a frequency within the first frequency band or the second frequency band as electromagnetic radiation having a first polarization in the same respective frequency bands and does not reflect electromagnetic radiation having a second polarization within the third frequency band as electromagnetic radiation having the first polarization.

In some, but not necessarily all examples, the multi-frequency twist-reflector comprises a periodic conductive surface that provides frequency selectivity, a dielectric layer and a reflective surface.

In some, but not necessarily all examples, a thickness of the dielectric layer of the multi-frequency twist-reflector is dependent upon both the first frequency band and the second frequency band.

In some, but not necessarily all examples, the multi-frequency twist-reflector comprises repeated parallel LC circuits each LC circuit providing a separate resonance.

In some, but not necessarily all examples, the multi-frequency twist-reflector comprises parallel, equally-spaced, discontinuous conductive strips, wherein conductive strip portions are separated in a first direction, parallel to the conductive strips, by first gaps and are separated in a second direction, orthogonal to the first direction, by second gaps.

In some, but not necessarily all examples, the first gaps have a constant size and wherein the second gaps have a constant size, the size of the first gaps being less than a size of the second gaps.

In some, but not necessarily all examples, the polarization-dependent trans-reflector is configured to have a single resonance impedance, wherein the first frequency band and the second frequency band are harmonic frequencies defined by the single resonance.

In some, but not necessarily all examples, the polarization-dependent trans-reflector comprises a polarization-selective reflective surface and a layer of dielectric, wherein the thickness of the dielectric depends on both the first frequency band and the second frequency band.

In some, but not necessarily all examples, the polarization-dependent trans-reflector comprises conductive strips on a dielectric, wherein a thickness of the dielectric is dependent upon both the first frequency band and the second frequency band such that the thickness of the dielectric corresponds to a first multiple number of half wavelengths for a resonant frequency of the first resonant frequency band and a multiple number of half wavelengths for a resonant frequency of the second frequency band.

In some, but not necessarily all examples, the multi-frequency folded lens antenna structure comprises a waveguide feed in the multi-frequency twist-reflector configured to provide electromagnetic radiation having the second polarization and having a frequency bandwidth covering at least the first frequency band and the second frequency band.

In some, but not necessarily all examples, the waveguide feed is configured to provide at one or more frequencies between 57 and 66 GHz which lies within the second frequency band and at frequencies substantially one half of 57 to 66 GHz which lie within the first frequency band.

In some, but not necessarily all examples, the multi-frequency folded lens antenna structure comprises a lens configured to receive electromagnetic radiation of the first polarization transmitted by the polarization-dependent trans-reflector.

In some, but not necessarily all examples, the lens is a Fresnel zone plate lens.

According to various, but not necessarily all, embodiments there is provided a base station comprising a backhaul radio frequency transceiver system comprising the multi-frequency folded lens antenna structure.

According to various, but not necessarily all, embodiments there is provided a polarization-dependent trans-reflector comprising:

parallel strips of conductor on a surface of a dielectric, wherein a thickness of the dielectric is dependent upon both the first frequency band and the second frequency band such that a thickness of the dielectric corresponds to a first multiple number of half wavelengths for a resonant frequency of the first resonant frequency band and a multiple number of half wavelengths for a resonant frequency of the second frequency band.

In some, but not necessarily all examples, a thickness of the dielectric corresponds to a wavelength for a resonant frequency of the second frequency band.

According to various, but not necessarily all, embodiments there is provided a multi-frequency twist-reflector comprising a dielectric layer supporting, on a first side, a reflective surface and supporting, on a second side opposing the first side, parallel, equally-spaced, discontinuous conductive strips defining conductive strip portions that are separated in a first direction, parallel to the conductive strips, by first gaps and are separated in a second direction, orthogonal to the first direction, by second gaps, wherein the first gaps have a constant size, and the second gaps have a constant size, the size of the first gaps being smaller the size of the second gaps, and wherein a thickness of the dielectric layer causes the multi-frequency twist-reflector to reflect electromagnetic radiation, having a second polarization and a frequency within a first frequency band or a second frequency band, as electromagnetic radiation having a first polarization in the same respective frequency bands and wherein electromagnetic radiation having a second polarization within a third frequency band is not reflected as electromagnetic radiation having the first polarization.

In some, but not necessarily all examples, the discontinuous conductive strips are configured to have a multi-resonant electrical impedance that is resonant at the first frequency band and at the second frequency band but not at the third frequency band, the third frequency band being between the first frequency band and the second frequency band, wherein a thickness of the dielectric layer substantially corresponds to a whole number of quarter wavelengths of a resonant frequency of the first frequency band and a whole number of quarter wavelengths of a resonant frequency the second frequency band.

According to various, but not necessarily all, embodiments there is provided examples as claimed in the appended claims.

BRIEF DESCRIPTION

Some example embodiments will now be described with reference to the accompanying drawings in which:

FIG. 1 shows an example embodiment of the subject matter described herein;

FIG. 2A, 2B, 20 each show another example embodiment of the subject matter described herein;

Figure 8A:
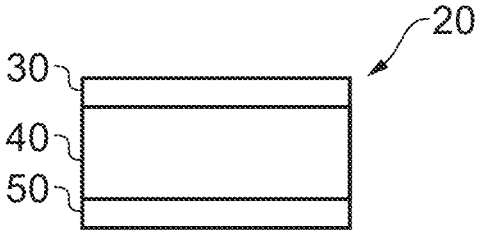
Figure 8B:
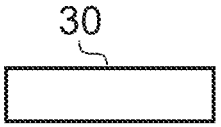
Figure 8C:
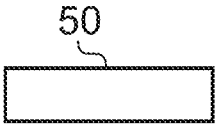
Figure 9:
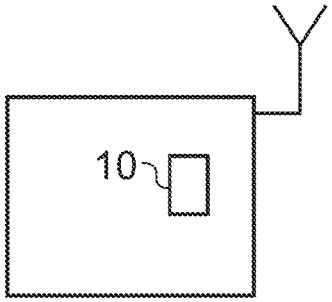

FIG. 8A, 8B, 8C each show another example embodiment of the subject matter described herein; and FIG. 9 shows another example embodiment of the subject matter described herein;

DETAILED DESCRIPTION

Figure 1:
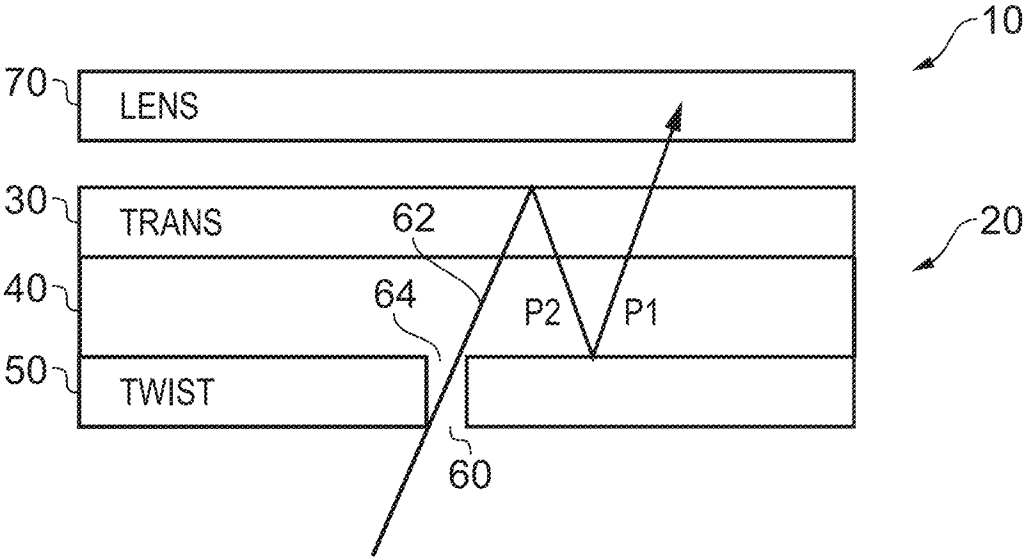

FIG. 1 illustrates an example of a multi-frequency folded lens antenna structure 10. The multi-frequency folded lens antenna structure 10 comprises a stack 20 comprising: a polarization-dependent trans-reflector 30, a dielectric gap 40 and a multi-frequency twist-reflector 50.

The structure 10 is folded in that electromagnetic radiation 62 takes a zig-zag path through the stack 20 before it emerges from the stack 20. The electromagnetic radiation 62 that emerges from the stack 20 has been reflected by the trans-reflector 30 and also by the twist-reflector 50. The path length for the electromagnetic radiation 62 through the stack 20 is therefore significantly greater than the thickness of the stack 20 because of the two reflections. This means that a lens 70 may be placed adjacent the stack 20 that has a focal length F significantly greater than the height H of the stack 20 but substantially equal to the zig-zag path length L of the electromagnetic radiation 62 through the stack 20, where $F=L\approx 3H$. The multi-frequency folded lens antenna structure 10 is therefore a compact arrangement that enables the use of a lens that has a focal length greater than the height of the stack 20.

The polarization-dependent trans-reflector 30 is configured to transmit electromagnetic radiation of a first polarization P1 incident, from within the stack 20, out of the stack 20 and to reflect electromagnetic radiation of a second polarization P2 incident, within the stack 20, towards the multi-frequency twist-reflector 50.

The multi-frequency twist-reflector 50 is configured to selectively change the polarization of the reflected electromagnetic radiation, provided by the trans-reflector 30, from the second polarization P2 to substantially the first polarization P1 and to direct the electromagnetic radiation of substantially the first polarization P1, within the stack 20, towards the polarization-dependent trans-reflector 30 for at least partial transmission out of the stack 20.

The multi-frequency twist-reflector 50 is configured to selectively change the polarization for at least a first frequency band F1 and for at least a second frequency band F2, non-contiguous to the first frequency band F1. The multi-frequency twist-reflector 50 is also configured to not change the polarization for at least a third frequency band F3 between the first frequency band F1 and the second frequency band F2.

The multi-frequency folded lens antenna structure 10 may comprise, within the multi-frequency twist-reflector 50, an aperture 64 for receiving electromagnetic radiation 62 from a source 60. The source 60 may, for example, be a waveguide feed 60 or another feed such as a printed microstrip based feed such as, for example, an Aperture Coupled Microstrip Patch antenna. The source 90 have a wide bandwidth that covers at least separated frequency bands F1 and F2 or may be a multi-frequency feed for frequency band F1 and for frequency band F2.

In this example, but not necessarily all example the dielectric 40 is a single layer dielectric substrate that has an upper and a lower surface or a single layer material. The dielectric 40 may be a solid, liquid or gas. It may for example be air. In this example, the upper surface is directly adjacent the polarization-dependent trans-reflector 30 and the lower surface is directly adjacent the multi-frequency twist-reflector 50.

In this example, but not necessarily all examples, the waveguide feed 60 is configured to only provide electromagnetic radiation having the second polarization.

The bandwidth of the electromagnetic radiation 62 provided by the waveguide feed 60 has a bandwidth that covers at least some or all of the first frequency band F1 and some or all of the second frequency band F2.

The electromagnetic radiation 62 of the second polarization P2 provided by the source 64 is reflected by the polarization-dependent trans-reflector 30 towards the multi-frequency twist-reflector 50. The reflected electromagnetic radiation 62 of the second polarization P2, that lies within the first frequency band F1 and the second frequency band F2, is reflected by the multi-frequency twist-reflector 50 as frequency limited electromagnetic radiation 62 of (substantially) the second polarization P2. The frequency-limited electromagnetic radiation 62 of (substantially) the second polarization P2 is substantially transmitted by the polarization-dependent trans-reflector 30.

The first polarization P1 and the second polarization P2 are orthogonal linear polarizations, in this example.

The second frequency band F2 may lie within a desired communication band such as the V band for backhaul communication in a telecommunication system. The V band has a frequency range between 57 and 66 GHz. The first frequency band may, for example, lie at a sub-harmonic of the second frequency band for example in the range 23.5 to 33 GHz. In one particular example, the second frequency band F2 includes the frequency 80 GHz and the first frequency band F1 includes the frequency 28.5 GHz.

Figure 2B:
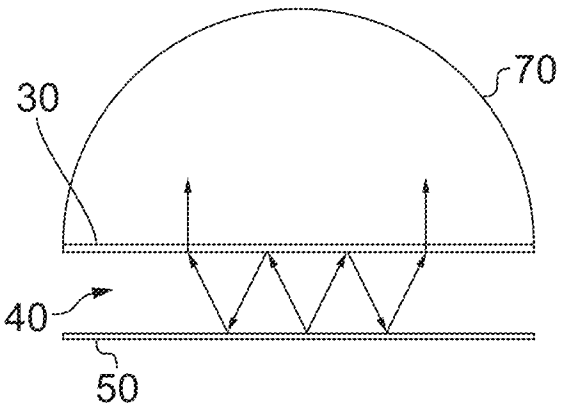
Figure 2C:
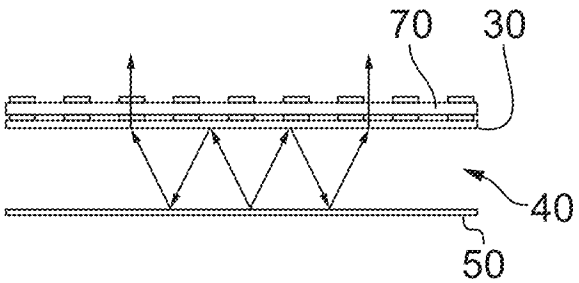
Figure 2A:
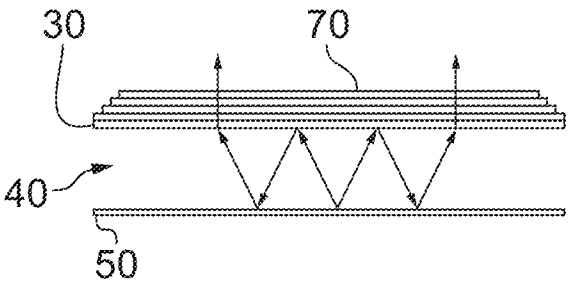

The lens 70 may be any suitable type of lens. For example, the lens may be a Fresnel lens, such as a folded Fresnel lens as illustrated in FIG. 2A or Fresnel zone plate lens. Alternatively, the lens 70 may be a hemispheric lens, for example as illustrated in FIG. 2B. Alternatively, the lens 70 may be a transmit array lens such as the folded transmit array lens illustrated in FIG. 2C.

Figure 3:
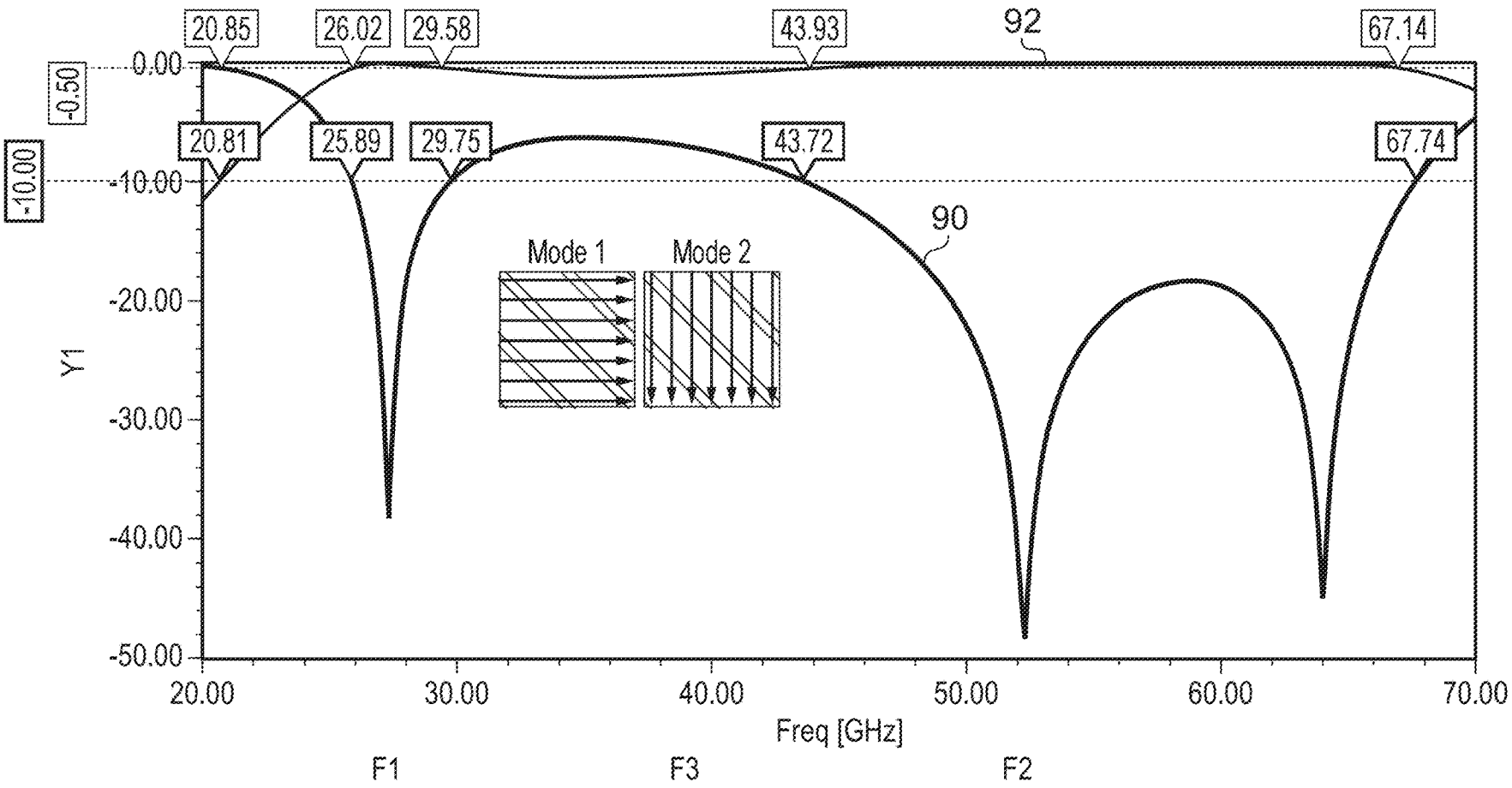
FIG. 3 shows another example embodiment of the subject matter described herein.
Figure 4:
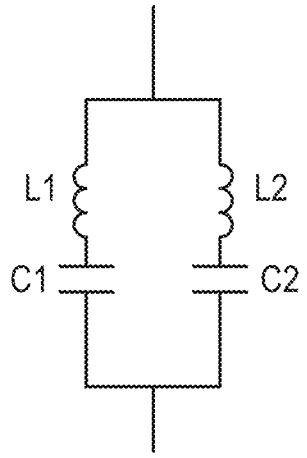
FIG. 4 shows another example embodiment of the subject matter described herein.
Figure 5:
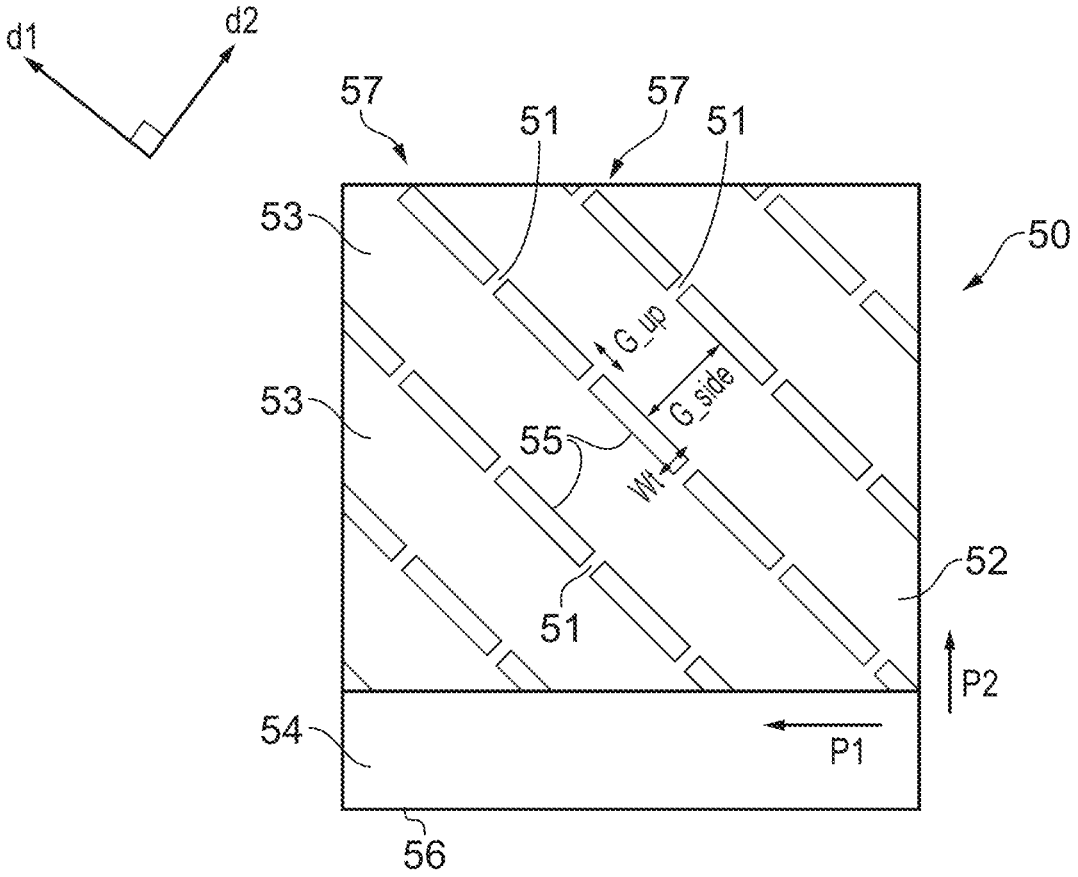
FIG. 5 shows another example embodiment of the subject matter described herein.

The operation of the multi-frequency twist-reflector 50 can be understood with reference to FIGS. 3, 4 and 5.

The multi-frequency twist-reflector 50 is configured to selectively change a polarization of incident electromagnetic radiation from the second polarization P2 to substantially the first polarization P1 and to reflect that electromagnetic radiation of substantially the first polarization P1 towards the polarization-dependent trans-reflector 30. The multi-frequency twist-reflector 50 is configured to selectively change the polarization of the incident electromagnetic radiation for at least a first frequency band F1 and for at least a second frequency band F2 but not for a third frequency band F3.

The first frequency band and the second frequency band are non-contiguous and, in the examples shown in FIG. 3, are separated by the third frequency band F3.

FIG. 3 illustrates 90 the return loss Snn (reflection coefficient) for transmission/reflection of the same polarizations. It can be seen from this FIG. that the loss is above a threshold value T (e.g. <−10 dB) across the first frequency band F1 and across the second frequency band F2 but not across the third frequency band F3.

FIG. 3 illustrates 92 the return loss Snm (reflection coefficient) of the multi-frequency twist-reflector 50 for the transmission/reflection of different orthogonal polarizations. It indicates a very small loss (e.g. >−0.5 dB) across the first frequency band F1 and across the second frequency band F2. It indicates a greater loss (e.g. <−0.5 dB) across the third frequency band F3.

Consequently, the multi-frequency twist-reflector 50 accepts electromagnetic radiation 62 within the first frequency band F1 and the second frequency band F2 for polarization change but rejects electromagnetic radiation 62 within the third frequency band F3 for polarization change.

It can therefore be observed by comparison that the multi-frequency twist-reflector 50 is selective as regards frequency. The multi-frequency twist-reflector 50 accepts incident electromagnetic radiation 62 of the second polarization P2 for a polarization change to the first polarization P1 when that incident radiation lies within the first frequency band F1 or within the second frequency band F2.

The multi-frequency twist-reflector 50 reflects incident electromagnetic radiation of the first frequency band F1, when it has the second polarization P2, as electromagnetic radiation of the same frequency, the first frequency band F1, but with a first polarization P1 instead of a second polarization P2.

The multi-frequency twist-reflector 50 reflects incident electromagnetic radiation of the second frequency band F2, when it has the second polarization P2, as electromagnetic radiation of the same frequency, the second frequency band F2, but with a first polarization P1 instead of a second polarization P2.

The multi-frequency twist-reflector 50 does not reflect incident electromagnetic radiation of the third frequency band F3, when it has the second polarization P2, as electromagnetic radiation of the same frequency, the third frequency band F3, but with a first polarization P1 instead of a second polarization P2.

The reflection coefficients 90, 92 illustrated in FIG. 3 are multi-resonant. This arises from a multi-resonant impedance of the multi-frequency twist-reflector 50.

The multi-resonance of the impedance of the multi-frequency twist-reflector may, for example, be understood by reference to a simplified equivalent electrical circuit as illustrated in FIG. 4. In this electrical circuit 80 a first arm 81 is in parallel with a second arm 82. The first arm 81 is modelled as a series combination of a first inductance L1 and a first capacitance C1. The second arm 82 is modelled as a series combination of a second inductance L2 and a second capacitance C2.

The electrical impedance Z of the equivalent circuit 80 is zero when $\omega^2 \cdot L1 \cdot C1 = 1$ and also when $\omega^2 \cdot L2 \cdot C2 = 1$, where $\omega = 2\pi f = 2\pi c/\lambda$.

There is consequently a first resonance dependent on the first inductance L1 and the first capacitance C1 and a second resonance dependent upon the second inductance L2 and the second capacitance C2. It is therefore possible to independently control and vary the first resonance associated with the first inductance L1 and the first capacitance C1 by designing the multi-frequency twist-reflector 50 to have controlled values for the first inductance L1 and/or the first capacitance C1. It is also possible to vary the second resonance associated with the second inductance L2 and the second capacitance C2 by designing the multi-frequency twist-reflector 50 to have controlled values for the second inductance L2 and/or the second capacitance C2.

It will be understood that in the example of FIG. 4, two zeroes have been created in the electrical impedance Z of the multi-frequency twist-reflector 50 by creating a cell comprising multiple parallel LC circuits. The cell is repeated over the surface of the multi-frequency twist-reflector 50 that receives the incident radiation 62.

FIG. 5 illustrates an example of a periodic conductive surface 52 that may be used in the multi-frequency twist-reflector 50. The periodic conductive surface 52 comprises islands of conductive patches 55 separated by gaps 51, 53.

The periodic conductive surface 52 provides frequency selectivity. In this example, the multi-frequency twist-reflector 50 comprises the periodic conductive surface 52, a dielectric 54 and a reflector surface 56. In this example, the dielectric 54 is a single layer dielectric substrate that has an upper and a lower surface. The upper surface comprises or is adjacent the periodic conductive surface 52 and the lower surface comprises or is adjacent the reflector surface 56.

The periodic conductive surface 52 can be formed by discontinuous metallization of the upper dielectric surface. The reflector surface 56 can be formed by continuous metallization of the lower dielectric surface.

In this example, but not necessarily all examples, the periodic conductive surface 52 is formed from parallel, equally spaced, discontinuous metal strips 57. The discontinuities in the metal strips create individual conductive portions 55. The strip portions 55 are separated by first gaps 51 in a first direction d1 and by second gaps 53 in a second direction d2, orthogonal to the first direction d1.

In this example, the conductive portions 55, each have a shape of a strip. They have a length in the first direction d1 than is multiple times greater than their width.

In this example, but not necessarily all examples, the strip portions 55 are in a single flat plane parallel to both the first direction d1 and the second direction d2 and parallel to the reflector surface 56.

In this example, but not necessarily all examples, the strip portions 55 and first gaps 51 alternate to form a strip line 57 and the strip lines 57 thus formed are separated by the second gaps 53.

In the example illustrated, the first gaps 51 have the same size, the second gaps 53 have the same size and the strip portions 55 have the same size. However, the first gap 51 is not equal in size to the second gap 53. The first gap 51 is significantly smaller than the second gap 53. The first gap 51 is significantly smaller than a width of the strip portion 55 in the second direction d2. The second gap 53 is greater than the width of the strip portion 55 in the second direction d2.

The strip portions 55 may be printed onto the upper surface of the dielectric 54.

It will be appreciated that the first gaps 51 may be associated with first capacitances C1 and that the second gaps 53 may be associated with second capacitances C2. The first gap 51 may be modelled as a first capacitance C1 in series with an inductance L1 provided by an adjacent strip portion 55 in the same strip line 57 as the first gap 51. The second gap 53 may be modelled as a second capacitance C2 in parallel to that inductance L1 and in series with an inductance L2 associated with a strip portion 55 in an adjacent strip line 57. Thus the periodic conductive surface 52 may be modelled as parallel LC circuits each providing a separate, different resonance.

The strip lines 57 in FIG. 5 have an orientation at 45° to the first polarization direction P1 and the second polarization direction P2, the first polarization direction and the second polarization direction being orthogonal.

The ability of the multi-frequency twist-reflector 50 to change the polarization of incident radiation 62 from the second polarization P2 to the first polarization P1 is dependent upon a thickness of the dielectric 54. The thickness of the dielectric 54 depends on both the first frequency band F1 and the second frequency band F2.

The multi-frequency twist-reflector 50 rotates the incident electromagnetic radiation having the second polarization P2 so that it has the first polarization P1. The periodic conductive surface 52 is selective. It reflects incident electromagnetic radiation that has a polarization aligned with the first direction d1 and transmits electromagnetic radiation that has a polarization aligned with the second direction d2. The reflective surface 56 reflects the transmitted electromagnetic radiation that has a polarization aligned with the second direction d2. The distance between the periodic conductive surface 52 and the reflective surface 56 is defined by the height of the dielectric 54. This distance needs to be such that it reverses the sign of the E-field of the electromagnetic radiation that has a polarization aligned with the second direction d2. This corresponds to the distance from the upper surface 52 to the lower surface 56 to the upper surface as being half a wavelength. This change in polarization changes the second polarization P2 to the first polarization P1.

The height of the dielectric 54 therefore needs to correspond to one quarter the wavelength of the incident radiation.

The incident radiation has two different frequency bands, the first frequency band F1 and the second frequency band F2.

The first frequency band F1 is associated with a first resonant frequency which defines a first resonant wavelength $\lambda_1$. The second frequency band F2 is associated with a second resonant frequency which defines a second resonant wavelength $\lambda_2$.

In some examples it may be desirable to select the height of the dielectric 54 in dependence upon the harmonics of the first resonant wavelength and the second resonant wavelength. For example, the dielectric height H may equal $n \times \lambda_1/4 = m \times \lambda_2/4$, where n and m are the lowest valued integers for which the equation is true.

It will be appreciated from the foregoing that there are a number of different parameters that may be varied to change the performance of the multi-frequency twist-reflector 50. For example, it may be possible to vary the width of the strip portions 51 in the second direction. It is desirable for these widths to be less than one half the resonant wavelength and preferably less than one tenth of the resonant wavelength. It is also possible to vary the length of the strip portions 55 by, for example, increasing the size of the first gap 51. For example, the first gaps 51 may have a size of approximately 0.02 of the upper resonant wavelength. It is also possible to vary the size of the second gaps 53 between the strip lines. For example, the second gap may have a size of approximately 0.3 of a resonant wavelength. For example, the first gaps 51 may have a size of less than 0.1 the size of the second gaps 53 between the strip lines.

Other parameters that may be varied include the height H of the dielectric layer 54 and also the permittivity of the dielectric 54. It will be appreciated that a change in the permittivity changes the wavelength of the electromagnetic radiation within the dielectric 54 and consequently changes the resonance wavelengths. It may be desirable for the dielectric 54 to be formed from a high permittivity material such as, for example, Arlon.

Figure 6:
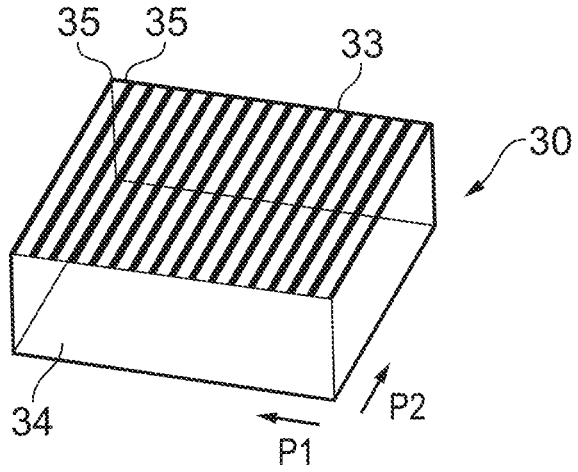
FIG. 6 shows another example embodiment of the subject matter described herein.

FIG. 6 illustrates an example of the polarization-dependent trans-reflector 30. The trans-reflector 30 comprises a polarization selective surface 32 that overlies a dielectric layer 34.

The polarization selective surface 32 comprises continuous conductive strips 35 on the surface of the dielectric 30. Gaps 33 separate the strips 35. The polarization selective surface 52 is configured to reflect incident electromagnetic radiation 62 that has the second polarization P2 and to transmit incident electromagnetic radiation 62 that has the first polarization P1, This occurs for the first frequency band F1 and the second frequency band F2.

In the example illustrated the second polarization P2 is parallel to the conductive strips 35 and the first polarization P1 is perpendicular to the conductive strips 35. The conductive strips 35 are parallel to the polarization P2 of the source 60 of the electromagnetic radiation 62.

The conductive strips 35 may be formed from metal.

Figure 7:
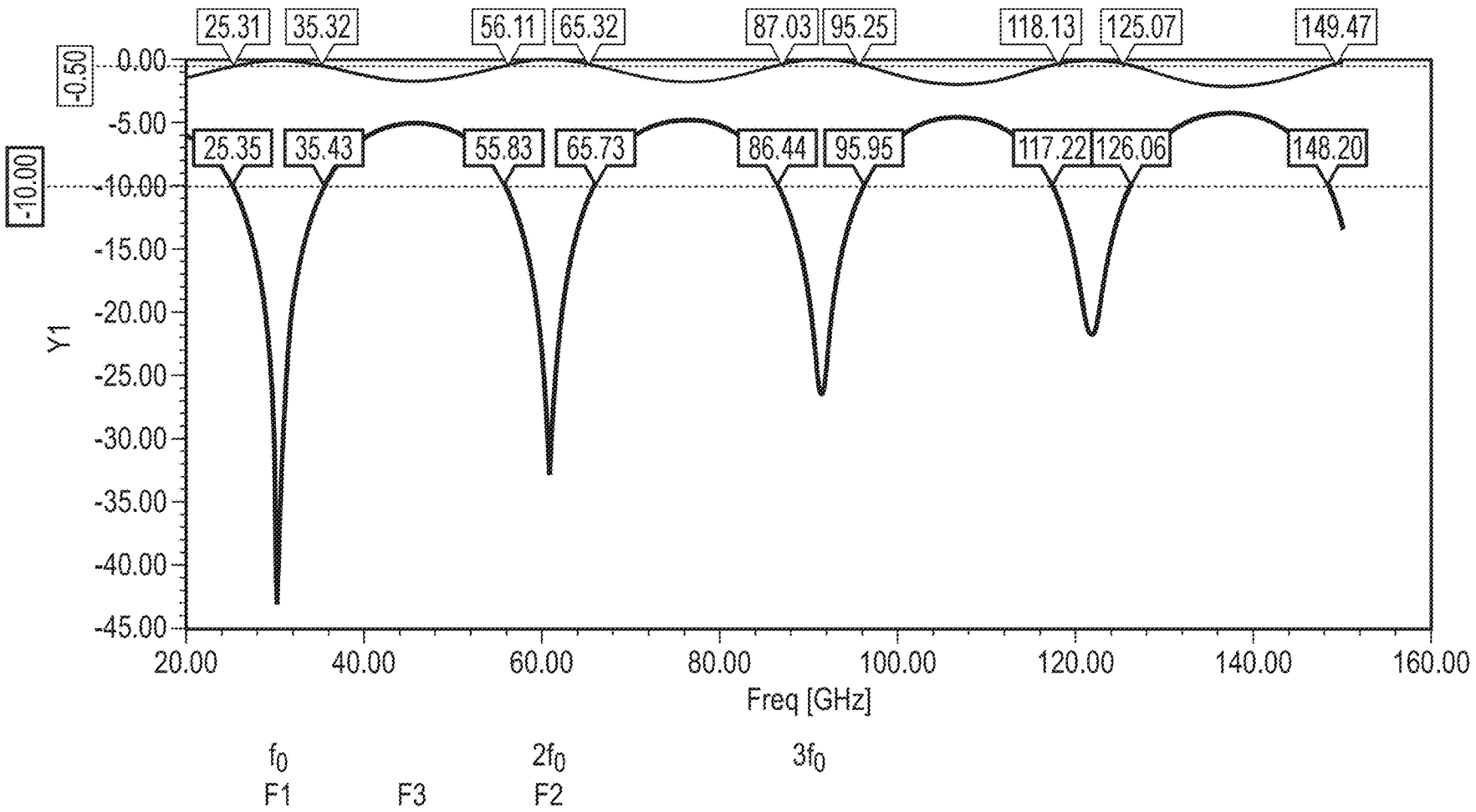
FIG. 7 shows another example embodiment of the subject matter described herein.

FIG. 7 illustrates an example of return loss S11 (reflection coefficient) for the trans-reflector 30 illustrated in FIG. 6 for the case where the incident is P1 (perpendicular to the strips). In this example, the polarization selective surface 52 can be modelled as a single LC circuit and has a single resonance. The fundamental resonance is illustrated in FIG. 7 as $f_0$. There will be additional harmonic resonances at multiples of the fundamental resonant frequency $f_0$. In this example, the first frequency band F1 corresponds to the fundamental resonant frequency $f_0$ and the second frequency band F2 corresponds to the first harmonic $2f_0$ of the fundamental frequency $f_0$.

The thickness (height) of the dielectric 34 depends on the first frequency band F1 and the second frequency band F2.

In some examples it may be desirable to select the height of the dielectric 34 in dependence upon the harmonics of the first resonant wavelength and the second resonant wavelength. For example, the dielectric height $h=a\times\lambda_1/2=b\times\lambda_2/2$, where a and b are the lowest valued integers for which the equation is true.

In the example where the first frequency band F1 corresponds to the fundamental resonant frequency $f_0$, which has an associated fundamental resonant wavelength $\lambda_o$, and the second frequency band F2 corresponds to the first harmonic $2f_0$ of the fundamental frequency $f_0$, then $\lambda_1=\lambda_o$ and $\lambda_2=\lambda_o/2$ and $h=\lambda_o/2$. The height h is half the fundamental resonant wavelength $\lambda_o$ (within the dielectric). This is one half the first resonant wavelength $\lambda_1$ and is the second resonant wavelength $\lambda_2$.

Referring back to the example in FIG. 6, the width of the strips may be less than one half a resonant wavelength and may, for example, be less than one fortieth of a resonant wavelength. The gaps 33 between strips 55 may be less than one twentieth of a resonant wavelength.

FIG. 8A illustrates an example of the multi-frequency folded lens structure 10 comprising the stack 20 but not comprising a lens 70 or a source 60 of electromagnetic energy 62. Such a multi-frequency folded lens structure 10 may be made and sold separately.

FIG. 8B illustrates an example of a polarization-dependent trans-reflector 30. The trans-reflector 30 may be made and sold separately.

The polarization-dependent trans-reflector 30 comprises, as previously described and illustrated, parallel strips of conductor 35 on a surface of a dielectric 34, wherein a thickness of the dielectric is dependent upon both the first frequency band F1 and the second frequency band F2 such that a thickness of the dielectric corresponds to a first multiple number of half wavelengths for a resonant frequency of the first resonant frequency band F1 and a multiple number of half wavelengths for a resonant frequency of the second frequency band F2. In some examples, the thickness of the dielectric 34 corresponds to a wavelength for a resonant frequency of the second frequency band.

FIG. 8C illustrates an example of multi-frequency twist-reflector 50. The multi-frequency twist-reflector 50 may be made and sold separately.

The multi-frequency twist-reflector 50 comprises, as previously described and illustrated, a dielectric layer 54 supporting, on a first side, a reflective surface 56 and supporting, on a second side opposing the first side, parallel, equally-spaced, discontinuous conductive strips 57 defining conductive strip portions 55 that are separated in a first direction d1, parallel to the conductive strips 57, by first gaps 51 and are separated in a second direction d2, orthogonal to the first direction, by second gaps 53. The first gaps 51 have a constant size. The second gaps 53 have a constant size. The size of the first gaps 51 is smaller than the size of the second gaps 53.

A thickness of the dielectric layer 54 causes the multi-frequency twist-reflector 50 to reflect electromagnetic radiation, having a second polarization P2 and a frequency within a first frequency band F1 or a second frequency band F2, as electromagnetic radiation having a first polarization P1 in the same respective frequency bands F1, F2. However, electromagnetic radiation having a second polarization P2 within a third frequency band F3 is not reflected as electromagnetic radiation having the first polarization P1.

The discontinuous conductive strips 57 are configured to have a multi-resonant electrical impedance that is resonant at the first frequency band F1 and at the second frequency band F2 but not at the third frequency band F3 (the third frequency band F3 being between the first frequency band F1 and the second frequency band F2). The thickness of the dielectric layer 54 substantially corresponds to a whole number of quarter wavelengths of a resonant frequency of the first frequency band F1 and a whole number of quarter wavelengths of a resonant frequency the second frequency band F2.

FIG. 9 illustrates an example of a base station 200 for a cell of cellular communication system. The base station 200 comprises a backhaul radio frequency transceiver system 202 comprising the multi-frequency folded lens antenna structure 10 for point-to-point communication, as described above.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although embodiments have been described in the preceding paragraphs with reference to various examples, it should be appreciated that modifications to the examples given can be made without departing from the scope of the claims.

Features described in the preceding description may be used in combinations other than the combinations explicitly described above.

Although functions have been described with reference to certain features, those functions may be performable by other features whether described or not.

Although features have been described with reference to certain embodiments, those features may also be present in other embodiments whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer and exclusive meaning.

The presence of a feature (or combination of features) in a claim is a reference to that feature) or combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example Whilst endeavoring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. A multi-frequency folded lens antenna structure comprising:

a stack comprising, a polarization-dependent trans-reflector, a dielectric gap, and a multi-frequency twist-reflector;

wherein the polarization-dependent trans-reflector is configured to transmit electromagnetic radiation of a first polarization incident from within the stack out of the stack and to reflect electromagnetic radiation of a second, different polarization incident within the stack towards the multi-frequency twist-reflector, and the multi-frequency twist-reflector is configured to selectively change a polarization of the reflected electromagnetic radiation from the second polarization to substantially the first polarization and to direct the electromagnetic radiation of substantially the first polarization, within the stack, towards the polarization-dependent trans-reflector for at least partial transmission out of the stack, wherein the multi-frequency twist-reflector is configured to selectively change the polarization for at least a first frequency band and for at least a second frequency band, non-contiguous to the first frequency band, wherein the multi-frequency twist-reflector comprises a periodic conductive surface that provides frequency selectivity, a dielectric layer, and a reflective surface, wherein the periodic conductive surface includes parallel, equally-spaced, discontinuous conductive strips defining conductive strip portions that are separated in a first direction, parallel to the conductive strips, by first gaps and are separated in a second direction, orthogonal to the first direction, by second gaps, wherein the first gaps have a constant first size, and the second gaps have a constant second size, the first size of the first gaps being smaller than the second size of the second gaps.

2. A multi-frequency folded lens antenna structure as claimed in claim 1, wherein the multi-frequency twist-reflector is configured to selectively change the polarization for at least the first frequency band and for at least the second frequency band, non-contiguous to the first frequency band and is configured to not selectively change the polarization for at least a third frequency band between the first frequency band and the second frequency band.

3. A multi-frequency folded lens antenna structure as claimed in claim 1, wherein the multi-frequency twist-reflector is configured to have a multi-resonant impedance comprising a resonance at the first frequency band and a resonance at the second frequency band.

4. A multi-frequency folded lens antenna structure as claimed in claim 3, wherein the multi-frequency twist-reflector is configured to have a multi-resonant impedance that is non-resonant at a third frequency band between the first frequency band and the second frequency band, wherein the multi-frequency twist-reflector reflects electromagnetic radiation having a second polarization and a frequency within the first frequency band or the second frequency band as electromagnetic radiation having a first polarization in the same respective frequency bands and does not reflect electromagnetic radiation having a second polarization within the third frequency band as electromagnetic radiation having the first polarization.

5. A multi-frequency folded lens antenna structure as claimed in claim 1, wherein a thickness of the dielectric layer of the multi-frequency twist-reflector is dependent upon both the first frequency band and the second frequency band.

6. A multi-frequency folded lens antenna structure as claimed in claim 1, wherein the multi-frequency twist-reflector comprises repeated parallel LC circuits, each of the LC circuits providing a separate resonance.

7. A multi-frequency folded lens antenna structure as claimed in claim 1, wherein the first gaps have a constant size and wherein the second gaps have a constant size, the size of the first gaps being less than a size of the second gaps.

8. A multi-frequency folded lens antenna structure as claimed in claim 1, wherein the polarization-dependent trans-reflector is configured to have a single resonance impedance, wherein the first frequency band and the second frequency band are harmonic frequencies defined by the single resonance.

9. A multi-frequency folded lens antenna structure as claimed in claim 1, wherein the polarization-dependent trans-reflector comprises a polarization selective reflective surface and a layer of dielectric, wherein the thickness of the dielectric depends on both the first frequency band and the second frequency band.

10. A multi-frequency folded lens antenna structure as claimed in claim 1, wherein the polarization-dependent trans-reflector comprises conductive strips on a dielectric, wherein a thickness of the dielectric is dependent upon both the first frequency band and the second frequency band such that the thickness of the dielectric corresponds to a first multiple number of half wavelengths for a resonant frequency of the first resonant frequency band and a multiple number of half wavelengths for a resonant frequency of the second frequency band.

11. A multi-frequency folded lens antenna structure as claimed in claim 1, further comprising:

a waveguide feed in the multi-frequency twist-reflector configured to provide electromagnetic radiation having the second polarization and having a frequency bandwidth covering at least the first frequency band and the second frequency band.

12. A multi-frequency folded lens antenna structure as claimed in claim 11, wherein the waveguide feed is configured to provide at one or more frequencies between 57 and 66 GHz which lies within the second frequency band and at frequencies substantially one half of 57 to 66 GHz which lie within the first frequency band.

13. A multi-frequency folded lens antenna structure as claimed in claim 1, further comprising:

a lens configured to receive electromagnetic radiation of the first polarization transmitted by the polarization-dependent trans-reflector.

14. A multi-frequency folded lens antenna structure as claimed in claim 13, wherein the lens is a Fresnel zone plate lens.

15. A base station comprising a backhaul radio frequency transceiver system comprising the multi-frequency folded lens antenna structure as claimed in claim 1.

16. A polarization-dependent trans-reflector comprising:

parallel strips of conductor on a surface of a dielectric, wherein a thickness of the dielectric is dependent upon both a first frequency band and a second frequency band such that a thickness of the dielectric corresponds to a first multiple number of half wavelengths for a resonant frequency of a first resonant frequency band and a multiple number of half wavelengths for a resonant frequency of a second frequency band.

17. A polarization-dependent trans-reflector as claimed in claim 16, wherein a thickness of the dielectric corresponds to a wavelength for a resonant frequency of the second frequency band.

18. A multi-frequency twist-reflector comprising:

A dielectric layer supporting, on a first side, a reflective surface and supporting, on a second side opposing the first side, parallel, equally-spaced, discontinuous conductive strips defining conductive strip portions that are separated in a first direction, parallel to the conductive strips, by first gaps and are separated in a second direction, orthogonal to the first direction, by second gaps, wherein the first gaps have a constant size, and the second gaps have a constant size, the size of the first gaps being smaller than the size of the second gaps, and wherein a thickness of the dielectric layer causes the multi-frequency twist-reflector to reflect electromagnetic radiation, having a second polarization and a frequency within a first frequency band or a second frequency band, as electromagnetic radiation having a first polarization in the same respective frequency bands and wherein electromagnetic radiation having a second polarization within a third frequency band is not reflected as electromagnetic radiation having the first polarization.

19. A multi-frequency twist-reflector as claimed in claim 18, wherein the discontinuous conductive strips are configured to have a multi-resonant electrical impedance that is resonant at the first frequency band and at the second frequency band but not at the third frequency band, the third frequency band being between the first frequency band and the second frequency band, wherein a thickness of the dielectric layer substantially corresponds to a whole number of quarter wavelengths of a resonant frequency of the first frequency band and a whole number of quarter wavelengths of a resonant frequency the second frequency band.

* * * * *